US008049587B2

(12) United States Patent
Israelsson Tampe et al.

(10) Patent No.: US 8,049,587 B2
(45) Date of Patent: Nov. 1, 2011

(54) COOLING SYSTEM FOR A DRY-TYPE AIR-CORE REACTOR

(75) Inventors: Stefan Israelsson Tampe, Västerås (SE); Peter Löfgren, Västerås (SE); Piotr Login, Ludvika (SE); Björn Jacobson, Västerås (SE)

(73) Assignee: ABB Research Ltd., Zürich (CH)

( * ) Notice: Subject to any disclaimer, the term of this patent is extended or adjusted under 35 U.S.C. 154(b) by 0 days.

(21) Appl. No.: 12/513,734

(22) PCT Filed: Nov. 6, 2006

(86) PCT No.: PCT/EP2006/068132

§ 371 (c)(1),
(2), (4) Date: Jan. 12, 2010

(87) PCT Pub. No.: WO2008/055538

PCT Pub. Date: May 15, 2008

(65) Prior Publication Data

US 2010/0117776 A1 May 13, 2010

(51) Int. Cl.
*H01F 27/02* (2006.01)

(52) U.S. Cl. ..... 336/59; 336/55; 336/57; 336/60; 336/61

(58) Field of Classification Search ..... 336/59, 336/57, 60, 61

See application file for complete search history.

(56) References Cited

U.S. PATENT DOCUMENTS 1,929,187 A * 10/1933 Johnson ..... 336/59
1,955,313 A 4/1934 Sauer
1,955,318 A * 4/1934 West et al. ..... 336/57
2,654,583 A * 10/1953 Treanor ..... 165/104.34
2,751,562 A * 6/1956 Guglielmo et al. ..... 336/60

(Continued)

FOREIGN PATENT DOCUMENTS

FR 932212 A 3/1948
JP 4142717 A 5/1992

OTHER PUBLICATIONS

PCT/ISA/210—International Search Report—Jun. 15, 2007.
PCT/IPEA/409—International Preliminary Report on Patentability—Oct. 2, 2008.

(Continued)

*Primary Examiner* — Anh Mai
*Assistant Examiner* — Joselito Baisa
(74) *Attorney, Agent, or Firm* — Venable LLP; Eric J. Franklin

(57) ABSTRACT

An air-core reactor with natural-air cooling of a winding includes first open spaces to let air flow through the winding in parallel with an axis of symmetry of the reactor and second open spaces crossing the first open spaces to let air flow through the winding angular to the axis of symmetry. A ventilation unit to produce a forced-air flow is arranged in such a way to the air-core reactor that a first part of the forced-air flow enters one of the first or second open spaces and at least one guiding element is arranged with respect to the crossing of the first and the second open spaces in such a way that the first part of the forced-air flow leaves and a second part of the forced-air flow enters the one of the first or second open spaces. A shielding element is arranged at another crossing of the first and the second open spaces so that substantially no air can leave or enter the one of the first or second open spaces.

11 Claims, 3 Drawing Sheets

U.S. PATENT DOCUMENTS

| | | | | | |
|---|---|---|---|---|---|
| 2,761,101 | A | * | 8/1956 | Gugliehno et al. | 361/37 |
| 3,364,838 | A | * | 1/1968 | Bradley | 312/213 |
| 3,902,147 | A | * | 8/1975 | Trench | 336/65 |
| 4,032,873 | A | | 6/1977 | Jallouk | |
| 4,146,112 | A | * | 3/1979 | Usry | 181/202 |
| 4,307,364 | A | * | 12/1981 | Lanoue et al. | 336/60 |
| 4,308,512 | A | * | 12/1981 | Capecchiacci et al. | 336/57 |
| 4,462,017 | A | * | 7/1984 | Knapp et al. | 336/207 |
| 4,538,131 | A | * | 8/1985 | Baier et al. | 336/57 |
| 5,027,099 | A | * | 6/1991 | Burke et al. | 336/60 |
| 6,897,657 | B2 | * | 5/2005 | Okada et al. | 324/321 |
| 7,205,875 | B2 | * | 4/2007 | Oughton et al. | 336/60 |

OTHER PUBLICATIONS

PCT/ISA/237—Written Opinion of the International Searching Authority—Jun. 15, 2007.

* cited by examiner

COOLING SYSTEM FOR A DRY-TYPE AIR-CORE REACTOR

CROSS-REFERENCE TO RELATED APPLICATIONS

This is the national phase under 35 U.S.C. §371 of PCT/EP2006/068132 filed 6 Nov. 2006.

The invention relates to a cooling system for a dry-type air-core reactor and to a method to convert an air-core reactor with natural-air cooling into an air-core reactor with forced-air cooling.

In today's power transmission and distribution systems, reactors are used to introduce an inductive reactance into the corresponding electrical circuit. A reactor can also be called an inductor. Its main component is a coil of insulated wire which can either be wrapped around a core of magnetic material, i.e. an iron core, or can be constructed in the form of a hollow body, i.e. a hollow cylinder or a hollow cuboid, with no magnetic material inside. The latter group of reactors is known as air-core reactors.

Air-core reactors are used in power systems for example as filter reactors to filter out undesired harmonics in a current transmitted to a power network, as shunt reactors to compensate for capacitive reactive power generated by long lightly loaded transmission lines, as neutral-grounding reactors to limit the line-to-ground current of a directly earthed network or as current-limiting reactors to limit short-circuit currents.

The winding of an air-core reactor used under high-voltage and high-current conditions of a power system produces considerable heat. Therefore, appropriate cooling is necessary to reduce the temperature in the reactor coil in order to minimize the losses and to avoid thermal ageing of the insulating material.

The cooling of an air-core reactor can be provided by insulating the reactor coil in a cooling fluid or by letting air flow alongside the coil windings. Air-cooled reactors are also known as dry-type reactors. In the known dry-type air-core reactors, natural convection is used to provide the necessary heat transfer.

In common designs of air-core reactors available on the market, the windings of the coil are divided by spacers into multiple packages. The spacers can be placed in parallel and in angular direction to the axis of symmetry of the reactor, as is for example disclosed in Patent Abstract of Japan JP4142717 and as is shown in the cross section diagram of FIG. 1. The air-core-reactor of FIG. 1 is of the hollow cylinder type and has a vertical axis of symmetry A. Parallel to the axis of symmetry A, spacers 3 are inserted in each of the three winding packages 1*a*, 1*b* and 1*c*, thereby creating multiple paths for the air to pass through in parallel direction to axis A. These paths are called first open spaces 3 or parallel spaces in the following. Three winding packages 1*a*, 1*b* and 1*c* are achieved by inserting two spacers perpendicular to the axis of symmetry A. These spacers create second open spaces 2*a* and 2*b* or so called angular spaces. Here, air can pass through between the winding packages 1*a* to 1*c* in perpendicular direction to the axis A.

In newer developments of power system technology, such as HVDC power transmission systems, air-core reactors are adapted to be used in connection with AC/DC-converters, which in some cases means that the number of required winding packages increases. This again increases the requirement for sufficient cooling of the winding.

Therefore, it is an object of the current invention to provide a cooling system for a dry-type air-core reactor with an increased number of winding turns or an increased length of the reactor core, respectively.

The invention is based on the recognition of the fact that natural convection results in an air stream flowing in vertical direction away from the ground. The direction of the air flow can mainly be either in parallel to the axis of symmetry in case the air-core reactor is placed with its axis of symmetry perpendicular to the ground, or in perpendicular direction in case the air-core reactor is places with its axis of symmetry parallel to the ground. Accordingly, the air flows mainly through the angular or the parallel spaces. In both cases is the heat of the reactor winding absorbed by the flowing air, so that the temperature of the air stream increases with increasing distance from ground.

Simulations have shown that the natural-air cooling works sufficiently especially in an outdoor environment, such as a switch-yard, but only up to a certain length of the reactor core or a certain width of the reactor winding, respective to the orientation of the axis of symmetry to the ground. In particular the topmost parts are in danger of suffering from hot spots and general overheating.

Further analysis has shown that the situation is aggravated if the reactor is placed in an indoor environment due to the limited amount of fresh air around the reactor.

The main idea behind the present invention is to ensure that possibly all of the fresh air available around the air-core reactor is used for cooling purposes.

The object of the invention is achieved by the provision of a cooling system.

In order to ensure that as much of fresh air as possible is used for cooling purposes, a forced-air cooling system is provided according to the invention. The cooling system comprises a ventilation unit which produces a forced-air flow. The cooling system is arranged in such a way to the reactor that a first part of the forced-air flow enters one of the first or second open spaces. According to the invention, at least one guiding element is arranged with respect to the crossing of the first and the second open spaces in such a way that the first part of the forced-air flow leaves and a second part of the forced-air flow enters the one of the first or second open spaces.

The at least one guiding element induces an exchange of air, where used and warmer air is forced to leave the winding and fresh and cooler is allowed to enter. The longer the air core or the broader the winding the more of the first and second open spaces and of respective guiding elements can be arranged inside the winding, so that sufficient cooling is ensured up to the topmost parts of the winding.

In an embodiment of the invention, the ventilation unit generates the forced-air flow outside of the winding, so that a higher air pressure exists outside of the air-core. The pressure difference causes the fresh air to tend to enter the air-core through the parallel or the angular open spaces, respective to the orientation of the axis of symmetry. The at least one guiding elements is used hereby to change the direction of the fresh air at the crossing of the parallel and the angular open spaces, so that the fresh air does not arrive at the air-core but bends off into the crossing open space. At the same time the guiding element blocks the pass-through for the used, warmer air and induces it to bend off into the air-core.

In another embodiment of the invention, the ventilation unit generates the forced-air flow inside of the air-core thereby generating a higher air pressure inside of the core. The guiding element is then arranged to effect the opposite directions of air-flow, guides the first and warmer part of the forced-air flow to the outside of the winding.

The forced-air cooling is especially suitable for indoor purposes as well as for other situations were natural convection is impaired. According to a further embodiment of the invention, the cooling air is enclosed by a substantially closed space leaving mainly one intake opening for fresh air to enter and another outlet opening for used air to leave the closed space. The intake and outlet openings can either be one big hole each or a multiple of small holes or a grid in a wall of the enclosure. By using several guiding elements a repeated exchange of used and fresh air is induced and the use of the cooling air available in the enclosure is optimized, which is especially advantageous in case of limited space and limited amount of cooling air.

In case of a closed space around the reactor, it is advantageous to provide at least one outlet shielding unit to prevent forced-air to flow directly to the outlet opening without entering the one of the first or second open spaces, thereby further optimizing the use of the air inside the closed space for cooling purposes.

Another advantageous embodiment of the closed-space solution is the provision of at least one intake shielding unit to prevent used air to flow back to the intake opening. Instead the used air is only allowed to flow to the outlet opening in order to leave the closed space without unnecessary delay.

If a multiple of crossings between the first and the second open spaces exist, it is suggested in a further embodiment to provide a shielding element and arrange it at the crossing of one first and one second open space so that substantially no air can leave or enter the one of the first or second open spaces. Such a shielding element supports the general direction of air-flow inside the winding. By a suitable mixture of guiding and shielding elements an optimized air-flow inside the winding can be achieved.

The ventilation unit comprises preferably a tube unit and a fan arranged inside the tube unit, the tube unit guiding the forced air-flow to the vicinity of the reactor.

The present invention is now described by way of example with reference to the accompanying drawings in which.

Figure 1:
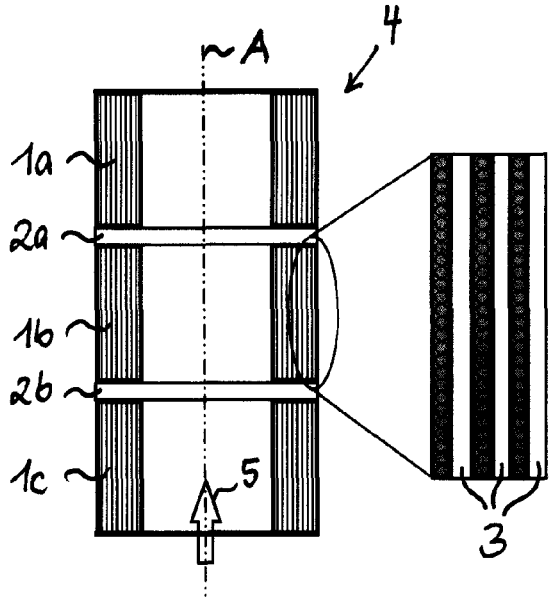
FIG. 1 shows a cross section of a known dry-type air-core reactor.

The cylindrical air-core reactor 4 shown in FIG. 1 was already described as known in the art as a dry-type air-core reactor with natural-air cooling. Its axis of symmetry A is positioned perpendicular to the ground so that natural air convection develops into the direction 5, i.e. parallel to the axis of symmetry A. The natural air stream flows in direction 5 through the air core as well as through the first open spaces 3.

Figure 2:
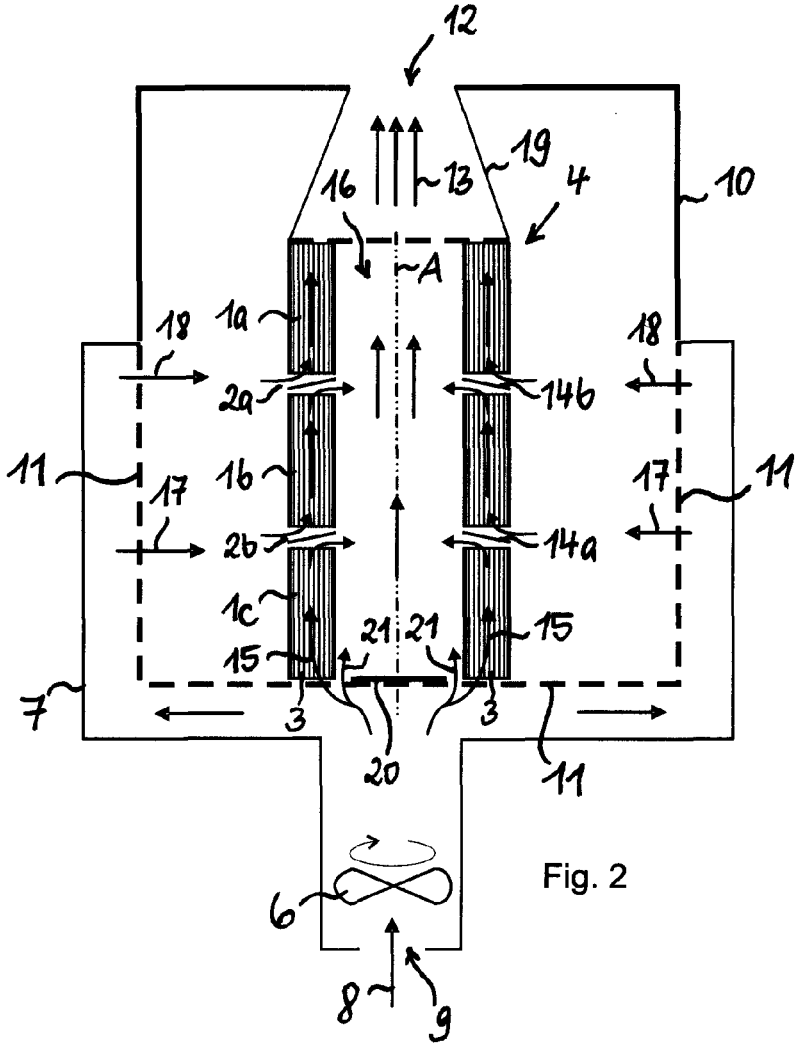
FIG. 2 shows the known reactor of FIG. 1 converted into an air-core reactor with outside forced-air cooling and a corresponding cooling system.

In FIG. 2 it can be seen how the reactor 4 is equipped with a cooling system, where the cooling system comprises a fan 6 and a tube unit 7 as well as two guiding elements 14*a* and 14*b*. The reactor 4 is placed inside a substantially closed room 10 which has intake openings 11 at the sides and at the bottom. The intake openings 11 are embodied as a plurality of little holes. Apart from that, the room 10 comprises an outlet opening 12 in the form of one hole at the top of the room 10, so that used air 13 can leave the room 10 in the same direction as the natural convection would induce. Accordingly, a substantially unified air stream develops inside the air core 16 and inside the first open spaces 3 which flows from one side of the reactor 4, i.e. the bottom, to the opposite side of the reactor 4, i.e. the top. The fan 6 is arranged inside the tube unit 7, and both together form a ventilation unit which is placed outside of room 10. Fresh air 8 can enter the tube unit 7 through an intake opening 9.

The cooling system works as follows. Forced air 15, 17, 18 and 21, produced by the fan 6, enters the room 10 through its inlet openings 11. Accordingly, the air pressure on the outside of the winding 1*a* to 1*c* is higher than inside the air core 16. A first part 15 of the forced air enters the first open spaces 3 in the reactor winding pack 1*c*. The first part 15 of the forced air then flows in parallel direction to the axis of symmetry A through the first open spaces 3 towards the second open space 2*b*. When the first part 15 reaches the crossing of the first and second open spaces 3 and 2*b*, the guiding element 14*a* forces the then warmed up and used air to change its direction and to leave into the air core 16. The guiding elements 14*a* and 14*b* each have basically the shape of the outside surface of a conical frustum. In the case of FIG. 2, where the outside pressure is higher than the inside pressure of the reactor 4, the guiding elements 14*a* and 14*b* are arranged in such a way that the shorter edge of the conical frustum shows away from the ground.

As a result of the pressure difference between the air core 16 and the outside of the windings, the other parts 17 and 18 of the forced air entering room 10 tend to flow in the direction of the second spaces 2*a* and 2*b* which would allow the forced air to enter into the lower pressure zone inside the air core 16. But when the second part 17 of the forced air enters the second open space 2*b*, it is forced by the guiding element 14*a* to change its direction and to enter the first open spaces 3 inside the winding package 1*b*. The sequence of used air leaving and fresh air 18 entering the first open spaces 3, recurs at the guiding element 14*b* between winding packages 1*b* and 1*a*.

In order to prevent fresh air to leave room 10 before it has entered either the first open spaces 3 or the air core 16, a hat 19 is arranged on top of the reactor 4 which closes the open space between the outer rim of the topmost reactor winding and the outlet opening 12. In the bottom of reactor 4, a lid 20 is used to prevent used air inside the air core 16 to flow back to the inlet opening 11 of room 10. The lid 20 leaves only minor openings for fresh air 21 to enter the air core 16 at its bottom. This part 21 of fresh air is used to cool the inner windings adjacent to the air core 16.

Figure 3:
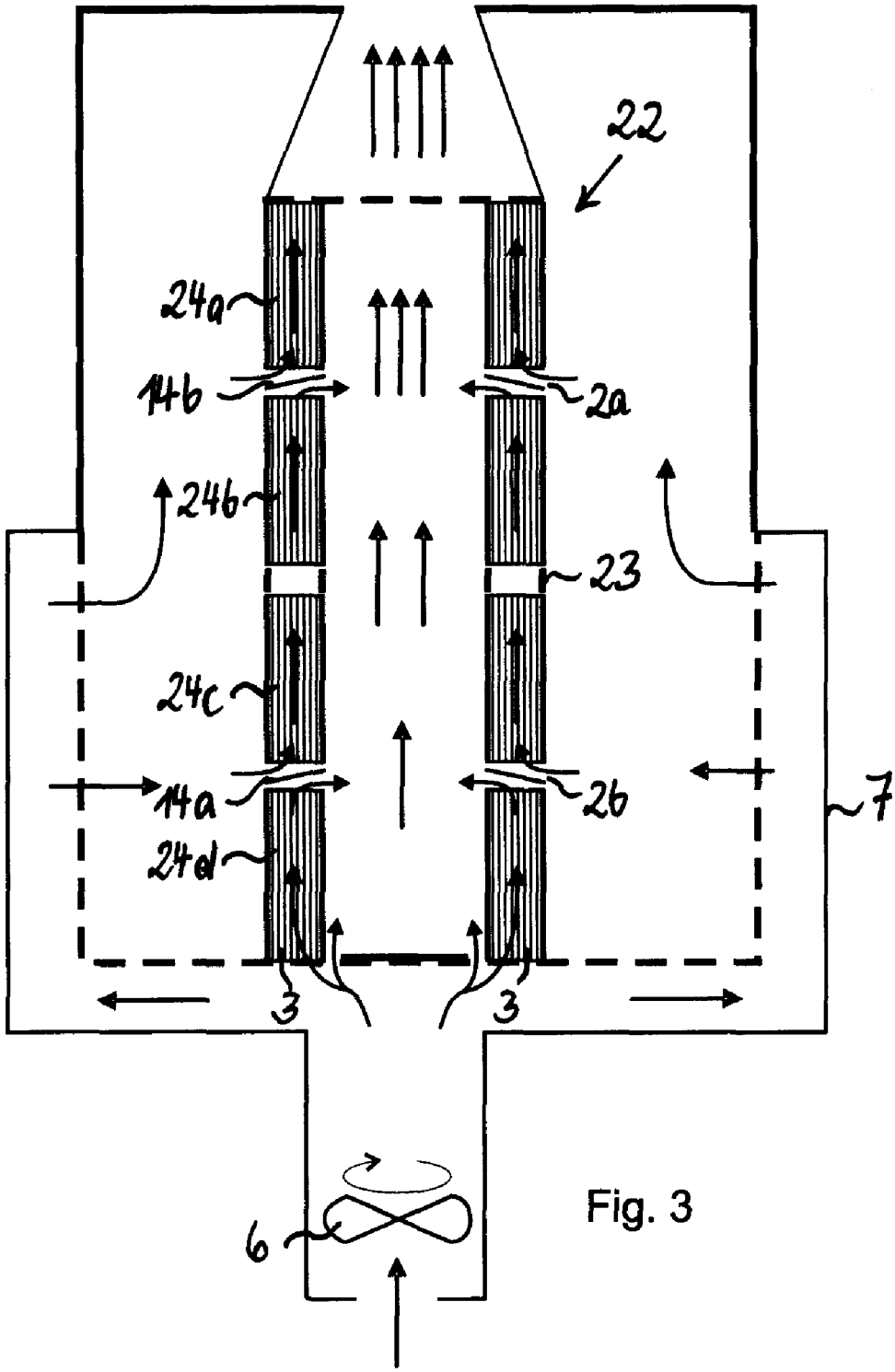
FIG. 3 shows a reactor and a cooling system comprising an additional shielding element and FIG. 4 shows the known reactor of FIG. 1 converted into an air-core reactor with inside forced-air cooling and a corresponding cooling system.

The cooling system for reactor 22 in FIG. 3 comprises the same parts as shown in FIG. 2. Additionally, a shielding element 23 is used, which has basically the form of two nested rings with the symmetrical axis A as common inner axis. The reactor 22 comprises four instead of three winding packages, where the guiding elements 14*b* and 14*a* are placed between the outermost winding packages 24*a* and 24*b* as well as 24*d* and 24*c*, respectively. The shielding element 23 is arranged between the inner winding packages 24*b* and 24*c* in order to keep up the main air stream inside the first open spaces of the inner winding packages 24*b* and 24*c*. The best suitable arrangement of guiding elements and shielding elements in different reactor types may for example be found out by way of simulation and/or testing.

Figure 4:
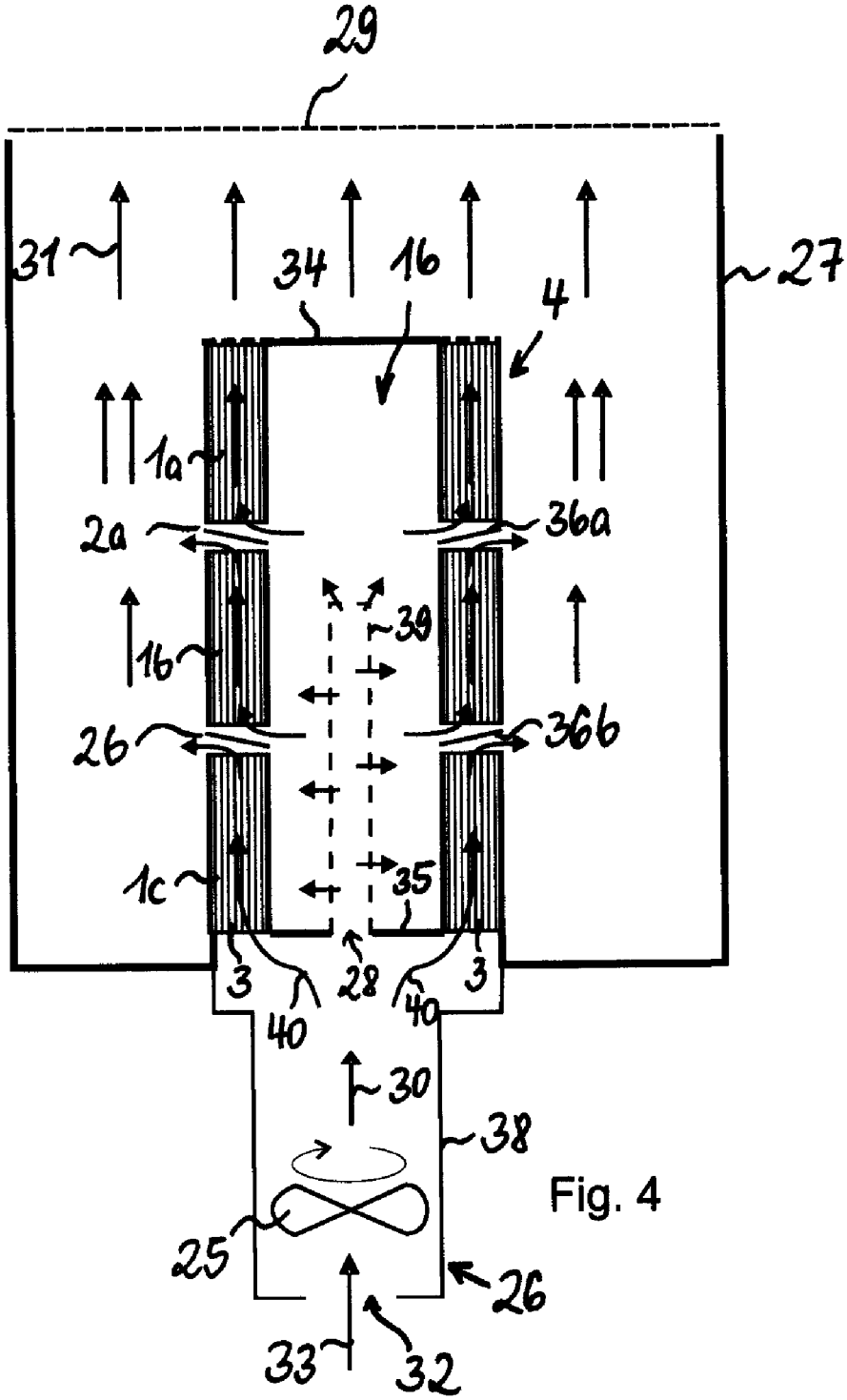

The reactor of FIG. 1 is also shown in FIG. 4, but it is equipped with another embodiment of the cooling system. In FIG. 4, a fan 25 is arranged inside a tube unit 26 which extends into the inside of the air core 16. A room 27 substantially encloses the reactor 4, comprising one intake opening

28 for forced and fresh air 30 to enter the room 27 and one outlet opening 29 in form of a multiple of holes at the top of the room 27 for used air to 31 to leave the room. The tube unit 26 consists mainly of two parts, one outer part 38 outside of room 27 and one inner part 39 inside of the air core 16. The outer part 38 has one intake opening 32 for fresh air 33 to enter, where the intake opening 32 lies outside of the room 27. Inside of the air core 16, the tube unit 26 possesses a multiple of holes to let forced air enter the room 27, thereby creating a higher air pressure inside the air core 16 than outside of the reactor winding 1*a* to 1*c*. A lid 34 at the top and a lid 35 at the bottom of the air core 16 prevent the forced and fresh air to leave the air core before the first open spaces 3 are entered. The bottom lid 35 leaves only two areas open: the entrance into the first open spaces 3 for the first part 40 of the forced air 30 to enter and the intake opening 32 for the remaining parts of the forced air 30 to flow into the upper part 39 of the tube unit 26. The only openings left where the forced air could leave the air core 16 to follow the pressure difference are the second open spaces 2*a* and 2*b*. In the second open spaces 2*a* and 2*b*, guiding elements 36*a* and 36*b* are arranged, respectively, which induce a change of direction on the forced air as well as on the used air entering the second open spaces 2*a* and 2*b*. As a result, the used air leaves the first open spaces 3 and the forced air enters the first open spaces 3. The guiding elements 36*a* and 36*b* have again basically the shape of the outside surface of a conical frustum. But in the case of FIG. 4, where the outside pressure is lower than the inside pressure of the reactor 4, the guiding elements 36*a* and 36*b* are arranged in such a way that the shorter edge of the conical frustum shows towards the ground.

The embodiments of FIGS. 1 to 4 are all shown with the symmetrical axis A of the reactor 4 or 22 arranged perpendicular to the ground. According to the invention it is also possible to arrange the reactor 4 or 22 with any other angle different from 90 degrees.

The invention claimed is:

1. A cooling system for a dry air-core reactor, the reactor comprising a winding around the air-core, the winding being divided into winding packages, the air core comprising:

first open spaces inside the winding packages to let air flow through the winding inside the winding packages in parallel with an axis of symmetry of the reactor and second open spaces crossing the first open spaces between winding packages to let air flow through the winding between winding packages angular to the axis of symmetry, the cooling system comprising:

a ventilation unit producing a forced-air flow, where a first part of the forced-air flow enters one of the first or second open spaces, at least one guiding element which is arranged with respect to a crossing of the first and the second open spaces in such a way that the first part of the forced-air flow leaves and a second part of the forced-air flow enters the one of the first or second open spaces, and a shielding element is arranged at another crossing of the first and the second open spaces so that substantially no air can leave or enter the one of the first or second open spaces.

2. The cooling system according to claim 1, wherein the ventilation unit generates the forced-air flow outside of the winding and the at least one guiding element guides the first part of the forced-air flow into the air-core.

3. The cooling system according to claim 1, wherein the ventilation unit generates the forced-air flow inside of the air-core and the at least one guiding element guides the first part of the forced-air flow to the outside of the winding.

4. The cooling system according to claim 1, wherein the cooling air is enclosed by a substantially closed space leaving mainly one intake opening for fresh air to enter and another outlet opening for used air to leave the closed space.

5. The cooling system according to claim 4, further comprising:

at least one outlet shielding unit to prevent forced-air to flow directly to the outlet opening without entering the first or second open spaces.

6. The cooling system according to claim 4, further comprising:

at least one intake shielding unit to prevent used air to flow back to the intake opening.

7. The cooling system according to claim 1, wherein the second open spaces are arranged perpendicular to the axis of symmetry.

8. The cooling system according to claim 1, wherein the ventilation unit comprises a tube unit and a fan arranged inside the tube unit.

9. A method to convert an air-core reactor with natural-air cooling into an air-core reactor with forced-air cooling, wherein the air-core reactor comprises a winding around the air core and divided into winding packages, first open spaces inside the winding packages to let air flow through the winding inside the winding packages in parallel with an axis of symmetry of the reactor, and second open spaces crossing the first open spaces between winding packages to let air flow through the winding between winding packages angular to the axis of symmetry, the method comprising:

arranging a ventilation unit to produce a forced-air flow towards the air-core reactor so that a first part of the forced-air flow enters one of the first or second open spaces, arranging at least one guiding element with respect to a crossing of the first and the second open spaces in such a way that the first part of the forced-air flow leaves and a second part of the forced-air flow enters the one of the first or second open spaces, and arranging a shielding element at another crossing of the first and the second open spaces so that substantially no air can leave or enter the one of the first or second open spaces.

10. The method according to claim 9, wherein the first open spaces are obtained via spacers inserted in each of the winding packages.

11. The cooling system according to claim 1, wherein the first open spaces are obtained via spacers inserted in each of the winding packages.

* * * * *